United States Patent [19]

Clark et al.

[11] Patent Number: 4,912,324

[45] Date of Patent: Mar. 27, 1990

[54] GLOW DISCHARGE SPECTROMETER

[75] Inventors: Jeremy D. H. Clark, Chester; Robert C. Hoodless, Winsford, both of England

[73] Assignee: VG Instruments Group Limited, Crawley, England

[21] Appl. No.: 314,555

[22] Filed: Feb. 23, 1989

[30] Foreign Application Priority Data

Feb. 24, 1988 [GB] United Kingdom ..... 8804290

[51] Int. Cl.[4] ..... H01J 49/04

[52] U.S. Cl. ..... 250/288; 250/281; 250/282

[58] Field of Search ..... 250/288, 281, 282

[56] References Cited

U.S. PATENT DOCUMENTS

| | | | |
|---|---|---|---|
| 4,794,252 | 12/1988 | Bateman et al. | 250/281 |
| 4,844,628 | 7/1989 | McLuckey et al. | 250/288 |
| 4,853,539 | 8/1989 | Hall et al. | 250/288 |

*Primary Examiner*—Janice A. Howell

*Assistant Examiner*—Kiet T. Nguyen

*Attorney, Agent, or Firm*—Chilton, Alix & Van Kirk

[57] ABSTRACT

The invention provides a mass spectrometer in an optical emission spectrometer having a glow discharge source which is suitable for the analysis of solid non-conducting samples. The source comprises a chamber into which an inert gas is introduced and maintained at a pressure substantially below atmospheric pressure, and two electrodes between which a glow discharge is struck by application of a direct or RF voltage to the electrodes. The cathode electrode comprises the solid non-conducting sample and an auxiliary electrode disposed between the discharge and the sample. The auxiliary electrode comprises an aperture through which the sample is exposed to the discharge. In the case of a mass spectrometer, ions formed in the discharge pass through an aperture in the chamber to a mass analyzer, while in the case of an optical emission spectrometer the chamber is sealed by a window through which radiation generated in the discharge can pass to an optical spectral analyzer.

22 Claims, 2 Drawing Sheets

GLOW DISCHARGE SPECTROMETER

This invention relates to a spectrometer incorporating a glow discharge source in which are formed ions and/or excited species characteristic of a sample, and in which the elemental composition of the sample is determined either by an optical spectroscopic analysis of the excited species or a mass spectrometric analysis of the ions. In particular it relates to the analysis of electrically non-conducting samples in such a spectrometer.

The elemental composition of an electrically conductive solid sample may be determined by making the sample one electrode of a glow discharge established in an inert gas such as argon maintained at a sub-atmospheric pressure. Preferably a DC discharge is employed, in which case the sample is made the cathode, but a discharge sustained by applying an RF potential between the sample and another electrode may also be used. Energetic positive ions generated in the discharge are accelerated towards the cathode sample and impact it with sufficient energy to sputter material from it. This material, typically atoms characteristic of the sample, enters the region of negative glow and is ionized or otherwise excited by collision with energetic species to emit photons. The ions so produced may be extracted from the discharge and subsequently mass analyzed (see, e.g., Harrison, Hess, Marcus and King, Analytical Chemistry, 1986, vol 58(2) pp 341A–356A), or the emission spectrum produced by the excited species may be analyzed with a suitable emission spectrometer. Both techniques employ very similar types of source, which typically comprises an enclosed cylindrical chamber into which argon is introduced at a pressure of 0.1–10 torr and a cathode electrode, typically disposed at one end of the chamber, which comprises the sample. A glow discharge is established in the chamber between the sample (cathode) and the chamber wall (anode), by maintaining a suitable potential difference between them. For use with a mass spectrometer the chamber is provided with a small aperture in the opposite end to the cathode through which ions can be extracted, and the chamber is disposed in the source vacuum envelope of the spectrometer so that it is evacuated through the ion-extraction aperture. For use with a optical emission spectrometer the source is provided with a window or lens in place of the ion-extraction aperture, and the chamber is completely sealed except for the gas inlet and an additional pumping port to which a small vacuum pump is connected.

The term "optical" is used throughout to include both UV and IR radiation as well as visible light.

In prior glow discharge spectrometers it is essential that the sample be either a conductive or a semiconductive material because it carries the electrical current which sustains the discharge (typically 1–5 mA, or greater in the case of an optical emission source). Non-conductive samples can be analyzed only by compacting the sample with a conductive powder (e.g. a metal or graphite powder) which is both inconvenient and likely to introduce contamination. It also precludes the analysis of a bulk solid non-conducting sample and the useful "depth profiling" type of analysis which can be carried out with solid conductive samples.

In the case of large-scale sputtering apparatus which employs a capacitively coupled RF glow discharge, it is known that a non-conducting material can sometimes be sputtered with the aid of a metallic mesh placed in front of the target. See, for example, Holland, Electronic Components, May 1970 pp 533–540. However, the inventors have found that use of a mesh in an analytical-scale DC source is unsuccessful. Although a glow discharge is formed, the sputtered material is found to be uncharacteristic of the sample. Greater success has been achieved using a mesh in conjunction with an inductively coupled RF glow discharge, but in such a source there is no current through the sample due to the discharge itself.

Non-conducting samples also present a problem in secondary ion mass spectrometric techniques where a solid sample is bombarded with a beam of ions, laser light, or neutral particles. In such techniques the sample surface becomes charged, and this interferes with the emission of secondary ions and/or the impact of charged particles. A wide variety of methods for reducing this problem have been proposed, including the use of a grid or diaphragm on the sample which acts as an electron sink. These methods are described in detail by Werner and Warmoltz in J. Vac. Sci. and Technol. A, 1984 (2) pp 726–31. However, the problem of analyzing non-conducting samples in a glow discharge source is substantially different from that of analyzing them using a primary beam bombardment technique, because in the former case the discharge cannot be produced at all unless the sample is sufficiently conductive to carry the current. Consequently the methods discussed by Werner and Warmholtz, which are concerned solely with minimizing charge accumulation on the sample, are not applicable to the problem of analyzing non-conductive samples in a glow discharge source.

It is an object of the present invention to provide a spectrometer for the determination of the elemental composition of a solid sample by means of a glow discharge source which has an improved performance when used for the analysis of non-conducting solid samples in comparison with prior spectrometers. It is a further object to provide a mass spectrometer having such a glow discharge source, and it is a yet further object to provide an optical emission spectrometer having such a glow discharge source.

In accordance with these objectives there is provided a spectrometer for the elemental analysis of a solid non-conducting sample, said spectrometer comprising:

(a) a substantially enclosed chamber into which an inert gas is introduced;

(b) means for maintaining the pressure in said chamber substantially less than atmospheric pressure;

(c) first and second electrode means disposed in said chamber, said first electrode means comprising said non-conducting sample;

(d) means for establishing a glow discharge in said inert gas between said first and second electrode means;

(e) spectrometric means for analyzing material removed from said non-conducting sample by the action of said glow discharge; said first electrode means further comprising an electrically conductive auxiliary electrode disposed between said glow discharge and said non-conducting sample and provided with at least one aperture through which said sample is exposed to said discharge.

Preferably the auxiliary electrode is in contact with the non-conducting sample.

In a preferred embodiment the invention provides a mass spectrometer comprising a mass analyzer and a vacuum envelope, in which the substantially enclosed chamber is disposed within the vacuum envelope and is provided with an aperture through which ions formed in the glow discharge may pass to the mass analyzer. In this embodiment the invention provides a mass spectrometer fitted with a glow discharge ion source which is capable of the determination of the elemental composition of a non-conducting solid sample.

In an alternative preferred embodiment the invention provides an emission spectrometer comprising an optical spectral analyzer, in which the chamber is evacuated through one or more pumping apertures and is provided with a window through which at least some radiation from said glow discharge which is characteristic of the elements comprised in said sample may pass to the optical spectral analyzer. In this embodiment the invention provides an emission spectrometer equipped with a glow discharge source which is capable of the determination of the elemental composition of a non-conducting sample.

Preferably a DC glow discharge is established in the chamber by application of a potential difference of approximately 1 kV between the first electrode means (cathode) and the second electrode means (anode). Conveniently the second electrode means comprises at least a part of the wall of the chamber. However, in a less preferred embodiment a capacitively coupled RF discharge may be employed with the RF power supply connected between the first and second electrode means.

Preferably a single aperture, with a characteristic or effective dimension substantially greater than 0.5 mm, is provided in the auxiliary electrode means. Further preferably the characteristic dimension is in the range 1.0 mm to 6.0 mm, and still further preferably it is substantially 2.0 mm. Conveniently the aperture is circular and has a diameter of 2.0 mm. However, a plurality of apertures, each with characteristic dimensions in the range specified, may also be employed.

The choice of material for the auxiliary electrode is dependent on the elements present in the non-conducting samples that are to be analyzed. Obviously, strong signals from the elements present in the electrode will be present in the spectrum and the material should be selected to ensure that none of the signals it generates cause significant interference to the elements to be determined. For example, tantalum is a suitable material except when iron is to be determined, because iron is usually a major contaminant in commercially available tantalum. High purity copper may also be used.

Use of an auxiliary electrode according to the invention permits a stable glow discharge to be established. Surprisingly, when an aperture of the size range specified is in use, very strong signals characteristic of the elements in the sample are observed, and depth profiling analysis can be carried out, at least in the region of the sample close to the edge of the aperture. It is observed that if the aperture is too small, material is sputtered from the auxiliary electrode on to the sample surface at a greater rate than it is removed, which leads to a substantial reduction in the signal due to the sample. If the aperture is too large, it becomes impossible to establish a steady glow discharge. Some experiment with the optimum side of the aperture is therefore desirable, although it is not particularly critical and satisfactory results can be obtained with most samples and auxiliary electrode materials with an aperture in the size range specified formed in a plate about 0.25 mm thick.

The invention will now be described in greater detail by way of example only and by reference to the following figures, in which FIG. 1 is a schematic diagram of a mass spectrometer according to the invention;

Figure 1:
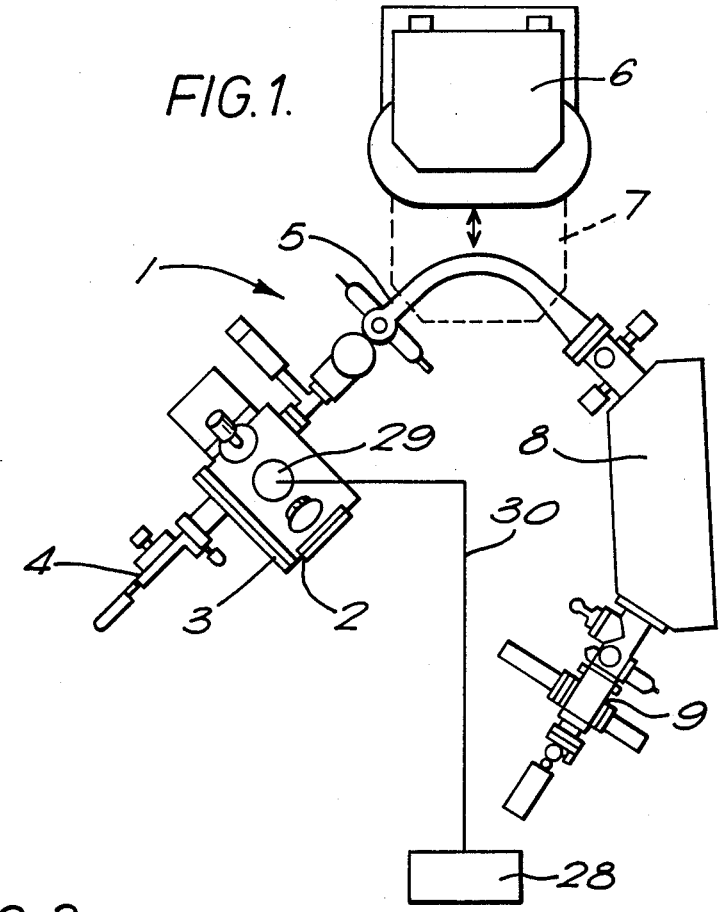

Referring to FIG. 1, a mass spectrometer according to a preferred embodiment of the invention has a vacuum envelope comprising a source housing 2, a flight tube 5, an electrostatic analyzer housing 8 and an ion detector housing 9. The source housing 2 contains a glow discharge ion source, described in detail below.

Source housing 2 is closed by a removable flange 3. A sample introduction probe assembly 4 is fitted on flange 3 and is used to introduce a solid non-conductive sample into the spectrometer through an insertion lock in the normal way. Ions formed in the discharge source leave the source housing 2 and pass through the flight tube 5. These ions are mass analyzed by a mass analyzer comprising an electromagnet 6 (shown displaced from its operating position 7 for clarity) and an electrostatic analyzer contained in the housing 8, and the ions finally enter an ion detector enclosed in housing 9. Electromagnet 6, the electrostatic analyzer and the detector constitute a conventional double-focusing mass spectrometer, the construction of which is well known. It will be appreciated however that other types of mass analyzer may be used if desired.

Figure 3:
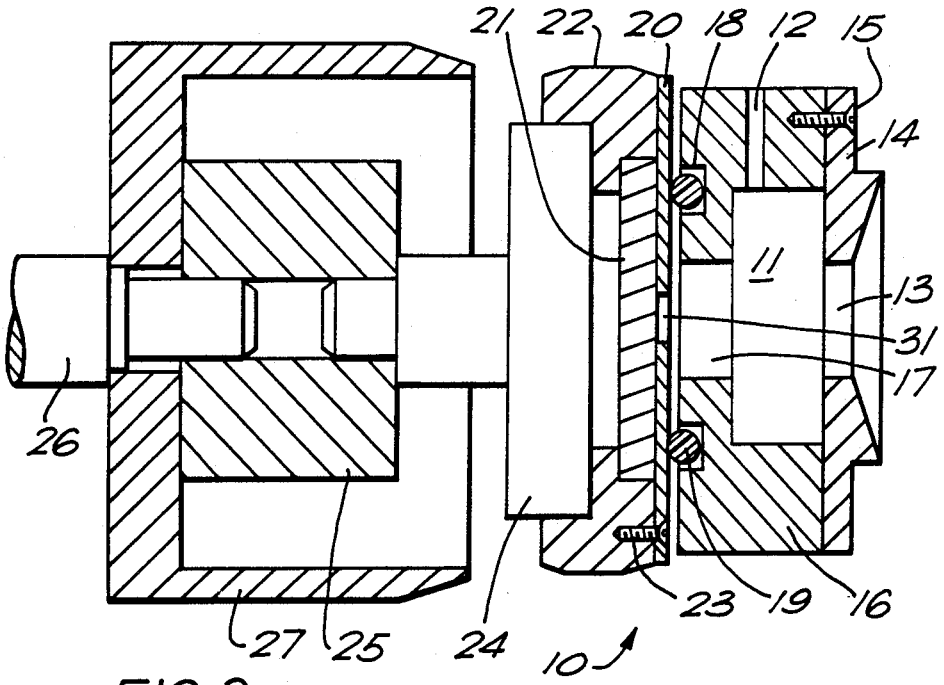
FIG. 3 is a drawing of a glow discharge source suitable for use in the mass spectrometer shown in FIG. 1.

Referring next to FIG. 3, a glow discharge ion source 10 within the housing 2 of the spectrometer comprises a substantially enclosed chamber 11 of cylindrical form into which an inert gas (typically argon) is introduced through an inlet 12 in body 16 of chamber 11 which is connected to aport (not shown) on housing 2. Source housing 2 is evacuated by the high-vacuum pumps (not shown) of the mass spectrometer and maintained at a pressure of $10^{-4}$ torr or lower. An ion-exit aperture 13 is provided in an end wall 14 of chamber 11. End wall 14 is fitted to body 16 by three screws 15 and makes a substantially gas tight seal therewith. As well as allowing ions generated in the chamber 11 to pass into the flight tube 5 (FIG. 1), aperture 13 also provides means for maintaining the pressure of inert gas in chamber 11 substantially below atmospheric pressure by virtue of the pumping which occurs through it as a result of the low pressure maintained in source housing 2.

The face of body 16 remote from end wall 14 contains a port 17 and a circular groove 18 of rectangular cross section which contains an 'O' ring seal 19, preferably made of PTFE. In operation, an auxiliary electrode 20 is pressed against 'O' ring seal 19 as shown to substantially close port 17 and consequently chamber 11. 'O' ring seal 19 is sufficiently thick to ensure that the auxiliary electrode 20 does not contact the body 16. A non-conducting sample 21 is made in the form of a disc and fitted into a sample holder 22, to which the auxiliary electrode 20 is attached by three screws 23. The sample holder 22 is attached in turn to a mandrel 24 which is coupled to a flexible coupling 25. The outer end of the coupling 25 is in turn connected to the shaft 26 of insertion probe assembly 4, thereby allowing the sample holder 22 and the non-conducting sample 21 to be withdrawn from the housing 2 to permit the sample to be changed without admitting air into the source housing 2. The flexible coupling 25 ensures that the auxiliary electrode 20 is always held in sealing engagement with 'O' ring seal 18 when the shaft 26 is fully inserted, even if the axis of shaft 24 is not exactly perpendicular to the rear face of body 16, due to manufacturing errors. Electrical connection to the auxiliary electrode 20 is made through the holder 22, mandrel 24, coupling 25 and a bonnet 27 which engages with a contact (not shown) inside source housing 2 when shaft 26 is fully inserted.

A glow discharge is established in the inert gas in chamber 11 between a first electrode means comprising the non-conducting sample 21, auxiliary electrode 20 and the sample holder 22, and a second electrode means which comprises the body 16 of the source 10. Means for maintaining a glow discharge between the first and second electrode means comprises a direct current power supply 28 (FIG. 1) which generates approximately 1 kV potential difference at a current of 10 mA. Supply 28 is connected by a cable 30 to a vacuum feedthrough assembly 29 on housing 2 to the first and second electrode means of the source with the negative lead of the supply connected to the firs electrode means comprising the sample.

An aperture 31 in the auxiliary electrode 20 is provided so that part of the surface of the non-conducting sample 21 is exposed to the glow discharge. In the preferred embodiment shown in FIG. 3, the aperture is a circular hole of approximately 2 mm diameter, and the auxiliary electrode 20 is approximately 0.25 mm thick. However, one or more apertures within the size ranges previously specified may be employed. As explained, the presence of the auxiliary electrode and its aperture allow a stable glow discharge to be maintained in chamber 11, and ions characteristic of the sample 21 formed in the glow discharge leave the source through aperture 13 in the end wall 14. In the case of a mass spectrometer incorporating a magnetic sector analyzer such as that illustrated in FIG. 1, extraction of the ions through aperture 13 is achieved by virtue of an electrostatic field maintained between the body 16 and an apertured electrode disposed between the source and the entrance to flight tube 5, as in a conventional mass spectrometer. This field is created by maintaining the second electrode means (comprising body 16 and end wall 14) at the accelerating potential of the spectrometer and the apertured electrode at the potential of the flight tube 5 and source housing 2. Consequently the power supply 28, cable 30 and feedthrough assembly 29 must be capable of safe operation at that accelerating potential, which is typically +8 kV above ground potential.

Figure 2:
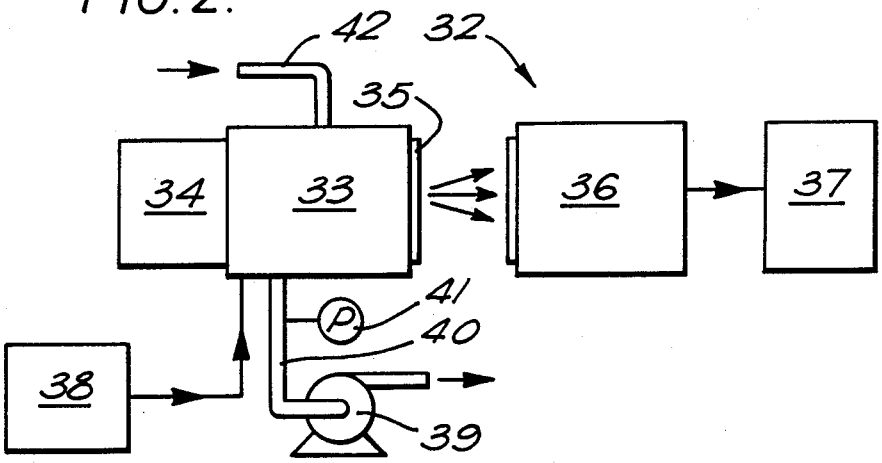
FIG. 2 is a schematic diagram of an optical emission spectrometer according to the invention.

Referring next to FIG. 2, an optical emission spectrometer 32 according to the invention comprises a glow discharge source 33, described in detail below, fitted with a sample introduction system schematically shown at 34 for introducing a solid non-conducting sample. Source 33 is fitted with a window 35 through which radiation characteristic of the elements comprised in the sample which is generated by the glow discharge inside source 33 passes to a spectral analyzer 36 adapted record the spectrum of the radiation emitted in a data acquisition system 37. Data acquisition system 37 may comprise a suitably programmed digital computer.

Means for establishing a glow discharge in the source 33 comprise a glow discharge power supply 38, similar to supply 28 previously described for the FIG. 1 embodiment. Source 33 is completely sealed, with the exception of inlet 47 and aperture 48 (FIG. 4), and is connected to a vacuum pump 39 via a pipe 40 and a pressure gauge 41. A supply of inert gas is connected through an inlet pipe 42. Pipe 40 is fitted with a variable flow restrictor (not shown) between pump 39 and gauge 41 so that pump 39, the restrictor, gauge 41 and pipe 40 comprise means for maintaining the pressure inside source 33 substantially below atmospheric pressure. Typically this pressure will be between 1 and 10 torr, at which pressure the glow discharge can be sustained.

Figure 4:
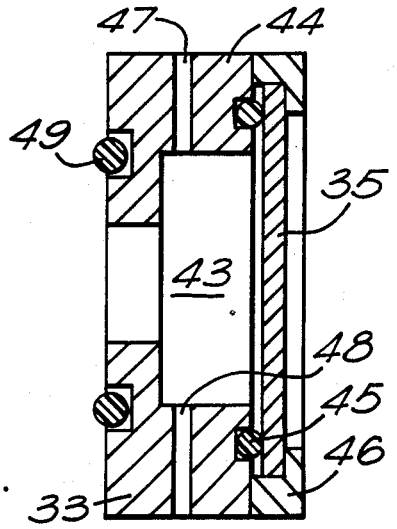
FIG. 4 is a drawing of part of the source illustrated in FIG. 3 showing the modifications required of use in the emission spectrometer shown in FIG. 2.

Referring next to FIG. 4, source 33 comprises a substantially enclosed chamber 43 formed in a cylindrical body 44. In place of the end wall 14 of the FIG. 3 embodiment, a quartz window 35 is clamped by a clamping ring 46 in sealing engagement with an 'O' ring seal 45 disposed in a circular groove of rectangular cross-section cut in the end face of body 44. A gas inlet 47 connected to pipe 42, and a pumping aperture 48 connected to pipe 40, are provided in the body 44. The remainder of source 33 is similar to the mass spectrometer version illustrated in FIG. 3, so that the 'O' ring seal 49 is in sealing engagement with the auxiliary electrode 20 (FIG. 3) when a sample is in position, sealing chamber 43 and allowing a glow discharge to be established in it as in the case of the FIG. 3 embodiment. The sample introduction system 34 comprises a probe assembly similar to that shown in FIG. 3 except that there is no requirement for the vacuum lock assembly illustrated at 4 in FIG. 1, because the source 33 is disposed in a region of atmospheric pressure.

As explained, the operation of an emission spectrometer source according to the invention is very similar to that of a mass spectrometer source, with the exception that radiation emitted through the window 35 is spectrally analyzed by the spectral analyzer 36 in order to determine the elemental composition of the non-conducting sample.

What is claimed is:

1. A spectrometer for the elemental analysis of a solid non-conducting sample, said spectrometer comprising:
   (a) a substantially enclosed chamber into which an inert gas is introduced;
   (b) means for maintaining the pressure in said chamber substantially less than atmospheric pressure;
   (c) first and second electrode means disposed in said chamber said first electrode means comprising said non-conducting sample;
   (d) means for establishing a glow discharge in said inert gas between said first and second electrode means;
   (e) spectrometric means for analyzing material removed from said non-conducting sample by the action of said glow discharge;
   said first electrode means further comprising an electrically conductive auxiliary electrode disposed between said glow discharge and said non-conducting sample and provided with at least one aperture through which said sample is exposed to said discharge.

2. A spectrometer according to claim 1 in which said auxiliary electrode is in contact with said non-conducting sample.

3. A mass spectrometer according to claim 1 further comprising a mass analyzer and a vacuum envelope, in which said substantially enclosed chamber is disposed within said vacuum envelope and in which said chamber is provided with an aperture through which ions formed in said glow discharge may pass to said mass analyzer.

4. A mass spectrometer according to claim 3 in which said auxiliary electrode is in contact with said non-conducting sample.

5. A mass spectrometer according to claim 3 in which sad glow discharge is a DC glow discharge established by application of a direct voltage between said first and second electrode means, and said first electrode means comprises a cathode electrode.

6. A mass spectrometer according to claim 3 in which said glow discharge is a capacitively coupled RF discharge established by application of an RF voltage between said first and second electrode means.

7. A mass spectrometer according to claim 3 in which said aperture in said auxiliary electrode has a characteristic or effective dimension greater than 0.5 mm.

8. A mass spectrometer according to claim 3 in which said aperture in said auxiliary electrode has a characteristic or effective dimension in the range 1.0–6.0 mm.

9. A mass spectrometer according to claim 3 in which said aperture in said auxiliary electrode has a characteristic or effective dimension of approximately 2.0 mm.

10. A mass spectrometer according to claim 3 in which said aperture is circular and has a diameter of approximately 2.0 mm.

11. A mass spectrometer according to claim 3 in which said auxiliary elect rode comprises tantalum.

12. A mass spectrometer according to claim 3 in which said auxiliary electrode comprises high-purity copper.

13. An emission spectrometer according to claim 1 further comprising an optical spectral analyzer, in which said chamber is evacuated through one or more pumping apertures and is provided with a window through which at least some radiation from said glow discharge which is characteristic of the elements comprised in said sample may pass to said optical spectral analyzer.

14. An emission spectrometer according to claim 13 in which said auxiliary electrode is in contact with said non-conducting sample.

15. An emission spectrometer according to claim 13 in which said glow discharge is a DC glow discharge established by application of a direct voltage between said first and second electrode means, and said first electrode means comprises a cathode electrode.

16. An emission spectrometer according to claim 13 in which said glow discharge is a capacitively coupled RF discharge established by application of an RF voltage between said first and second electrode means.

17. An emission spectrometer according to claim 13 in which said aperture in said auxiliary electrode has a characteristic or effective dimension greater than 0.5 mm.

18. An emission spectrometer according to claim 13 in which said aperture in said auxiliary electrode has a characteristic or effective dimension in the range 1.0–6.0 mm.

19. An emission spectrometer according to claim 13 in which said aperture in said auxiliary electrode has a characteristic or effective dimension of approximately 2.0 mm.

20. An emission spectrometer according to claim 13 in which said aperture is circular and has a diameter of approximately 1.0 mm.

21. An emission spectrometer according to claim 13 in which said auxiliary electrode comprises tantalum.

22. An emission spectrometer according to claim 13 in which said auxiliary electrode comprises high-purity copper.

* * * * *